US005609197A

United States Patent [19]

Liao

[11] Patent Number: 5,609,197

[45] Date of Patent: Mar. 11, 1997

[54] APPARATUS FOR HANGING CURTAINS

[76] Inventor: Shih-Lu Liao, No. 20, Thai-Shing Str., San-Ming Li, Shung-Kang Dist., Kaohsiung, Taiwan

[21] Appl. No.: 570,962

[22] Filed: Dec. 12, 1995

[51] Int. Cl.[6] ..... A47H 1/00

[52] U.S. Cl. ..... 160/330

[58] Field of Search ..... 160/330, 345, 160/348, 123, 124, 126, 346, 347; 16/87.2, 87.4 R, 87.6 R, 87.8, 93 D, 94 D, 95 D, 96 D

[56] References Cited

U.S. PATENT DOCUMENTS

| | | | |
|---|---|---|---|
| 2,901,037 | 8/1959 | Yohner et al. | 160/346 |
| 2,952,315 | 9/1960 | Brontman | 160/330 |
| 3,199,142 | 8/1965 | Salzmann et al. | 160/345 X |
| 3,361,191 | 1/1968 | Goble | 160/346 X |
| 3,399,713 | 9/1968 | Wilson | 160/348 |
| 3,422,879 | 1/1969 | Ryan | 160/330 |
| 4,582,109 | 4/1986 | Fairbanks | 160/348 X |
| 4,972,895 | 11/1990 | Meshaka | 160/330 |

*Primary Examiner*—David M. Purol
*Attorney, Agent, or Firm*—Varndell Legal Group

[57] ABSTRACT

An apparatus for hanging curtains including a track defining a longitudinal sliding groove, a plurality of carrier slides each having a projecting block slidably inserted in the sliding groove of the track and a bottom slope with a round hole disposed outside the rack, a plurality of hooks respectively fastened to the round holes of the carrier slides, and a plurality of hanging loops respectively fastened to the curtain by stitches for hanging on the hooks.

4 Claims, 4 Drawing Sheets

APPARATUS FOR HANGING CURTAINS

BACKGROUND OF THE INVENTION

The present invention relates to an apparatus for hanging curtains and, more particularly, to such an apparatus that allows curtains to be quickly hung on a track and to be quickly removed from the track for washing.

The apparatus for hanging curtains according to the prior art, as shown in FIG. 1, is generally comprised of a track, a plurality of carrier slides slidably mounted on the track, and a plurality of hooks respectively and detachably fastened to the carrier slides for hanging a curtain. Because the hooks must be fastened to the curtain before hanging, the installation procedure of the curtain is complicated. During the installation of the curtain, the user's hands can be injured by the hooks. Furthermore, repeated fastening and removal of the hooks to and from the curtain will damage the structure of the curtain.

SUMMARY OF THE INVENTION

According to the present invention, the apparatus for hanging curtains comprises a track having a longitudinal sliding groove, a plurality of carrier slides each having a projecting block slidably inserted in the sliding groove of the track and a bottom slope with a round hole disposed outside the track, a plurality of hooks respectively fastened to the round hole of the carrier slides, and a plurality of hanging loops respectively fastened to the curtain by stitches for hanging on the hooks. Because the hanging loops are made from cloth, fabric, or soft plastic, and fixed to the curtain, the curtain can be conveniently hung on the track or removed from the track. During the mounting or dismounting procedure of the curtain, the user's hands will be not injured by the hooks.

DETAILED DESCRIPTION OF THE PREFERRED EMBODIMENT

Figure 1:
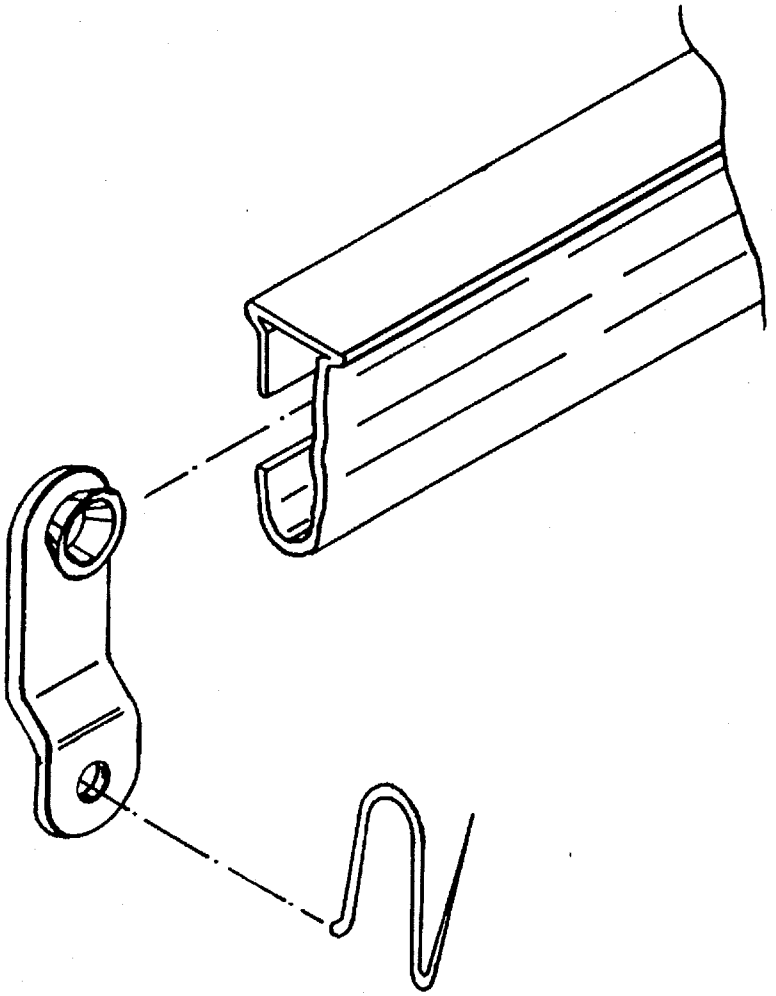
FIG. 1 PRIOR ART
FIG. 1 is an exploded view of an apparatus for hanging curtains according to the prior art.
Figure 2:
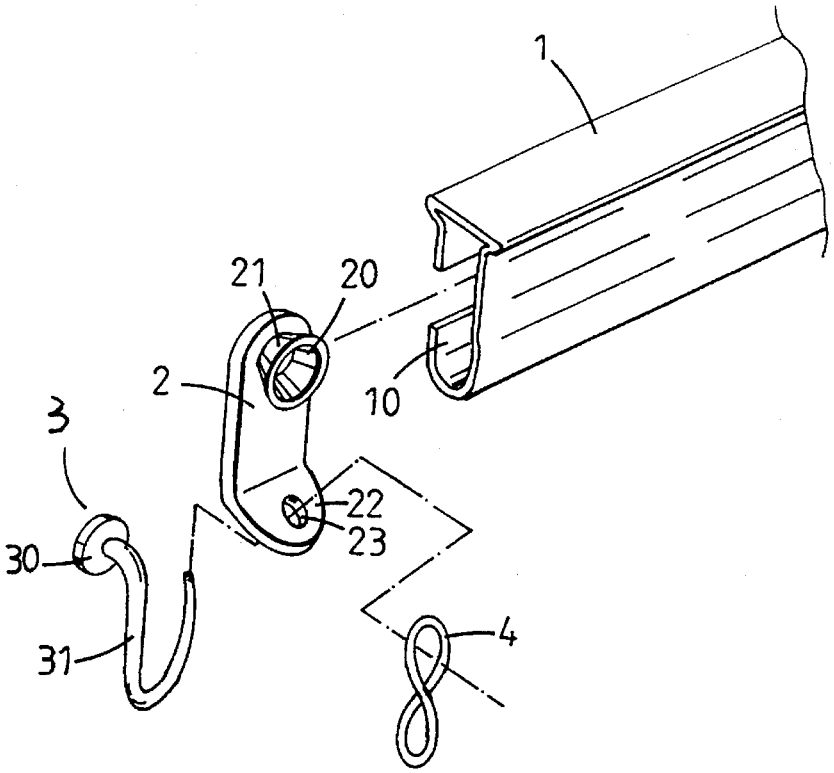
FIG. 2 is an exploded view of an apparatus for having curtains according to the present invention.
Figure 3:
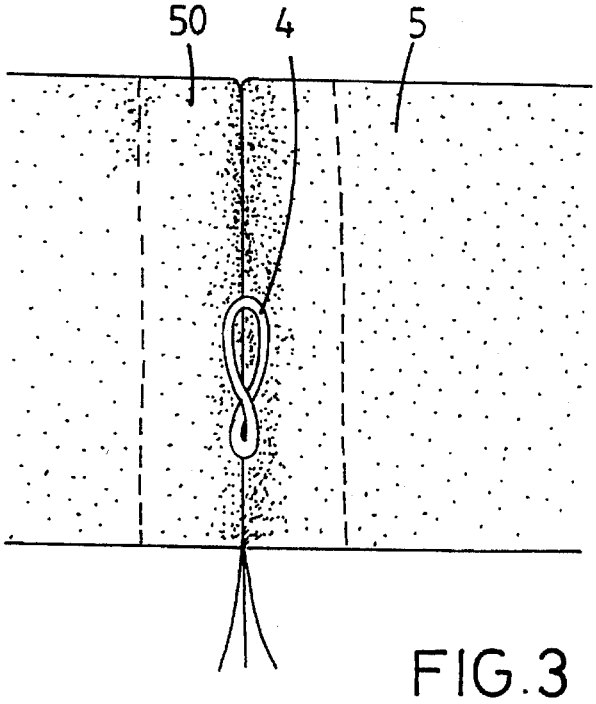
FIG. 3 is a front view showing one hanging loop fastened to the pleat of a curtain according to the present invention.
Figure 8:
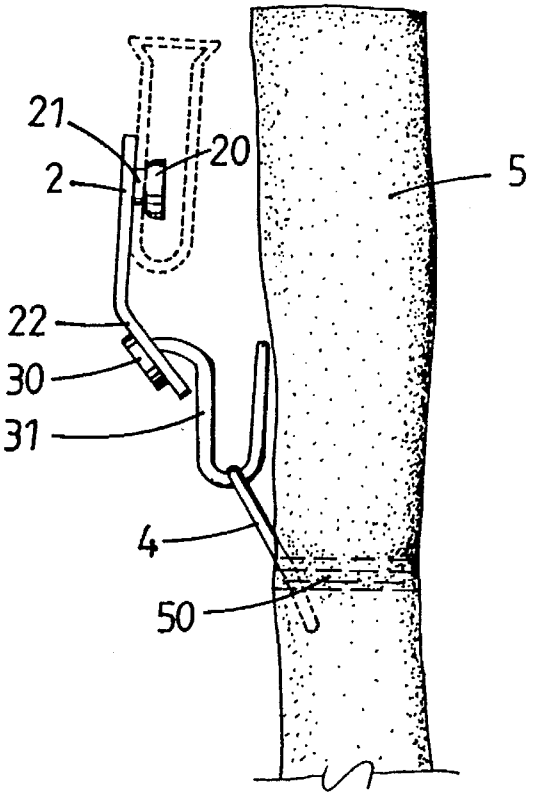
FIG. 8 is an installed view of the present invention, showing the hanging loop hung on the hook.
Figure 6:
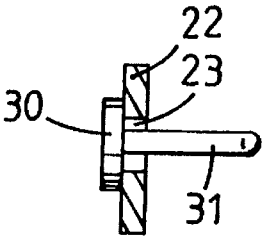
FIG. 6 shows the hook body of the hook fully inserted into the round hole of the bottom slope of the carrier slide according to the present invention.
Figure 7:
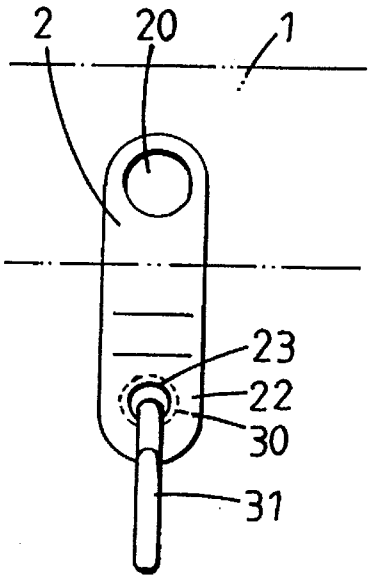
FIG. 7 is a front view showing the hook fastened to the carrier slide and the carrier slide hung on the track according to the present invention.
Figure 4:
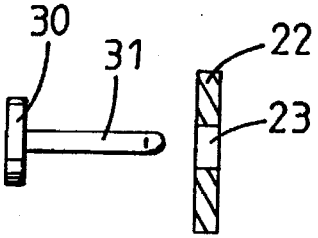
FIG. 4 shows the relative position between the hook and the round hole of the bottom slope of the carrier slide according to the present invention.
Figure 5:
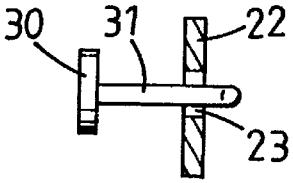
FIG. 5 shows the hook body of the hook partially inserted into the round hole of the bottom slope of the carrier slide according to the present invention.

Referring to FIG. 2, an apparatus for hanging curtains in accordance with the present invention is generally comprised of a track 1, a plurality of carrier slides 2, a plurality of hooks 3, and a plurality of hanging loops 4. The track 1 defines a substantially T-shaped sliding groove 10 along its length in which the carrier slides 2 can slide. Each of the carrier slides 2 comprises a projecting block 20 having a neck portion 21 for slidably inserting into the T-shaped sliding groove 10, a bottom slope 22, and a round hole 23 at the center of the bottom slope 22 for mounting one hook 3. Each of the hooks 3 comprises a hook body 31 inserted through the round hole 23 of the bottom slope 22 of one carrier slide 2, and a rounded head 30 disposed at one end of the hook body 31 and abutting one side of the round hole 23. The hanging loops 4 are respectively twisted into the shape of "8" and then fastened to each pleat 50 of the curtain 5 by stitches (see FIG. 3).

Referring to FIGS. 4 through 8, the hook body 31 is a straight rod before the installation. After the hook body 31 is inserted through the round hole 23 of the bottom slope 22 of one carrier slide 2, it is bent into shape, permitting the rounded head 30 to be firmly secured to the back side of the bottom slope 22 (see FIGS. 4, 5, 6, and 7). When assembled, the projecting block 20 of each carrier slide 2 is inserted into the T-shaped sliding groove 10 of the track 1 (see FIG. 7), and then the curtain 5 is hung on the track 1 by hanging the hanging loops 4 on the hooks 3 respectively (see FIG. 8). By disconnecting the hanging loops 4 from the hooks 3, the curtain 5 is removed from the track 1 for cleaning.

Figure 9:
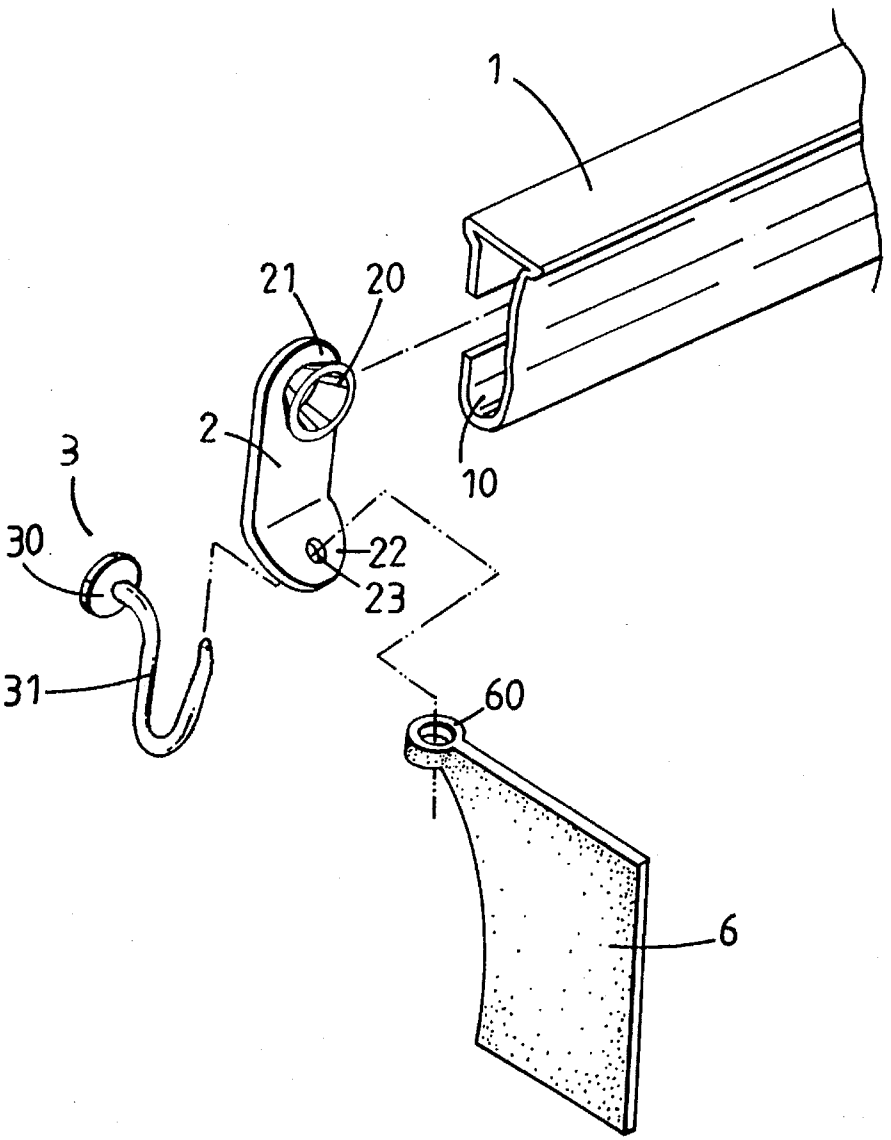
FIG. 9 shows an alternate form of the present invention.

FIG. 9 shows an alternate form of the present invention, in which the hanging loop, referenced by 60, has a flat projecting strip 6 raising from the periphery for fastening to the curtain by stitches. This hanging loop 6 can be directly molded from resilient plastic.

I claim:

1. A combination of an apparatus for hanging curtains and a curtain comprising a track having a longitudinal sliding groove, carrier slides, bendable hooks, and hanging loops; said carrier slides respectively having a projecting block fitting behind said longitudinal sliding groove, a neck sliding in said longitudinal sliding groove, a flat portion arranged in front of said longitudinal sliding groove, a bottom slope extending from said flat portion, and a hole in said bottom slope; said hooks respectively comprising a hook body and a rounded head, said hooks respectively arranged in said holes of said carrier slides by said hook body passing through said hole with said rounded head abutting said flat portion behind said hole and bending said hook body to secure said hook on said carrier slide by bending said hook body to have a straight portion extending at an angle from said rounded head and a U-shaped portion extending from said straight portion, and said hanging loops respectively and removably hooked on said hook bodies and fastened to pleats of said curtain by stitches.

2. The combination according to claim 1, wherein said hanging loops have a flat projecting strip fastened to the curtain.

3. A combination of an apparatus for hanging curtains and a curtain consisting of a track having a longitudinal sliding groove, carrier slides, bendable hooks, and hanging loops; said carrier slides respectively having a projecting block fitting behind said longitudinal sliding groove, a neck sliding in said longitudinal sliding groove, a flat portion arranged in front of said longitudinal sliding groove, a bottom slope extending from said flat portion, and a hole in said bottom slope; said hooks respectively comprising a hook body and a rounded head, said hooks respectively arranged in said holes of said carrier slides by said hook body passing through said hole with said rounded head abutting said flat portion behind said hole and bending said hook body to secure said hook on said carrier slide by bending said hook body to have a straight portion extending at an angle from said rounded head and a U-shaped portion extending from said straight portion, and said hanging loops respectively and removably hooked on said hook bodies and fastened to pleats of said curtain by stitches.

4. The combination according to claim 3, wherein said hanging loops have a flat projecting strip fastened to the curtain.

* * * * *